US005960634A

United States Patent [19]

Hook et al.

[11] Patent Number: 5,960,634

[45] Date of Patent: Oct. 5, 1999

[54] METHOD AND APPARATUS FOR STORING ACETYLENE

[75] Inventors: David P. Hook, Crawley Down; Stephen W. Barton, Haslemere; Duncan Yates, Cranleigh; Silvia B. Dougill, London, all of United Kingdom; Shuen-Cheng Hwang, Chester, N.J.

[73] Assignee: The Boc Group PLC, Surrey, United Kingdom

[21] Appl. No.: 09/007,579

[22] Filed: Jan. 15, 1998

[30] Foreign Application Priority Data

Jan. 31, 1997 [GB] United Kingdom ..... 9702095

[51] Int. Cl.[6] ..... F17C 11/00

[52] U.S. Cl. ..... 62/46.1; 62/54.1; 252/67; 252/71

[58] Field of Search ..... 62/46.1, 54.1; 252/67, 71

[56] References Cited

U.S. PATENT DOCUMENTS

| | | | |
|---|---|---|---|
| 3,393,152 | 7/1968 | Smith et al. | 62/46.1 |
| 3,574,276 | 4/1971 | Strelzoff | 62/46.1 |
| 3,861,160 | 1/1975 | Walker | 62/46.1 |
| 4,045,189 | 8/1977 | Bruni et al. | 62/46.1 |
| 5,531,075 | 7/1996 | Behringer et al. | 62/46.1 |
| 5,806,318 | 9/1998 | DiIorio et al. | 62/46.1 |

FOREIGN PATENT DOCUMENTS 856 977 1/1952 Germany .

*Primary Examiner*—Ronald Capossela

*Attorney, Agent, or Firm*—Coleman R. Reap; Salvatore P. Pace

[57] ABSTRACT

A method and apparatus of storing and transporting acetylene in which acetylene is introduced under pressure into liquid nitrogen to produce a liquid solid mixture. The feeding of the acetylene can be done by spraying the acetylene over the liquid nitrogen or sparging the acetylene into a pool of liquid nitrogen.

3 Claims, 1 Drawing Sheet

METHOD AND APPARATUS FOR STORING ACETYLENE

BACKGROUND OF THE INVENTION

The present invention relates to the storage and transportation of acetylene.

Acetylene has utility in industry, in particular, metal fabrication such as gas welding and gas cutting operations but has the disadvantage that it is highly unstable. If an ignition source is present, pure acetylene under pressure as low as 1.4 bar absolute will decompose with violence.

One known method of stabilising acetylene is to dissolve the acetylene in a suitable solvent, for example acetone, to lower its activity. The resulting solution is then absorbed in a porous mass or filler to inhibit the decomposition. With this known method, using acetone as the solvent, acetylene gas cylinders have a limiting safety pressure of 18.7 bar absolute at 15° C.

The main disadvantages of this known dissolved acetylene storage system are low storage capacity, low gas withdrawal rates, and no bulk storage or transportation capabilities.

An alternative to dissolved acetylene is to dilute the acetylene gas with another gas. Hydrocarbons, nitrogen, carbon dioxide, carbon monoxide and ammonia are the most common gases used to dilute and thereby stabilise acetylene. Dilution with 49% by volume nitrogen or 42% by volume carbon dioxide is needed to avoid acetylene decomposition at ambient temperature and a pressure of 5 bar a. Although the addition of diluents increases the pressure at which acetylene can be handled safely, the storage capacity and bulk transportation capability of acetylene are not improved.

Another alternative is to liquefy acetylene in a solvent at low temperatures, for example −90° C. at atmospheric pressure. For example, in UK Patent Number 729748 there is described a process for producing dissolved acetylene in which gaseous acetylene is dissolved at atmospheric pressure at a temperature of −94° C. or below in a solvent such as liquid carbon dioxide preferably in admixture with acetaldehyde and methylene chloride. The disadvantages are the high cost of the extreme cooling, the change of composition during withdrawal of either the vapour or the liquid and, the low pressure of the acetylene stored.

A third alternative is to store or transport liquid mixtures of acetylene and for example acetone or dimethylformamide at a temperature of −50° C. In this case, the equilibrium pressure is higher than atmosphere and, the vapour has to be stabilised by adding a gas insoluble in the liquid like, nitrogen, noble gases or carbon monoxide. The disadvantages are the difficulties in maintaining a safe gas composition and the contamination of acetylene by the other component of the mixture.

A fourth alternative is to store or transport acetylene in carbon dioxide as described in EP Patent Publication Number 0740104 as a mixture, liquid-vapour or solid-vapour. The advantages of this system are constant compositions of the liquid and vapour phases during withdrawal of either phase, when operated as an azeotropic mixture. High acetylene content in the vapour, liquid or in the solid mixtures is produced with a wide range of pressures and temperatures at which the mixtures are stable.

SUMMARY OF THE INVENTION

It is an aim of the present invention to provide an improved method for the storage and the bulk transportation of acetylene in which acetylene under pressure is introduced into liquid nitrogen to obtain a liquid-solid mixture.

According to one aspect of the present invention, a method of storing and transporting acetylene comprises the steps of introducing acetylene under pressure into liquid nitrogen to produce a liquid-solid mixture.

Preferably, the acetylene is fed to a pool of liquid nitrogen contained within a pressure vessel to produce a liquid-solid mixture.

According to a further aspect of the present invention, an apparatus for storing acetylene comprises a source of acetylene gas under pressure, a pressure vessel containing liquid nitrogen and means for feeding the acetylene to the liquid nitrogen to produce a liquid-solid mixture.

BRIEF DESCRIPTION OF THE DRAWINGS

An embodiment of the invention will now be described, by way of example, reference being made to the FIGURE of the accompanying diagrammatic drawing which is a schematic diagram of apparatus for the production and storage of acetylene.

DETAILED DESCRIPTION

Figure 1:
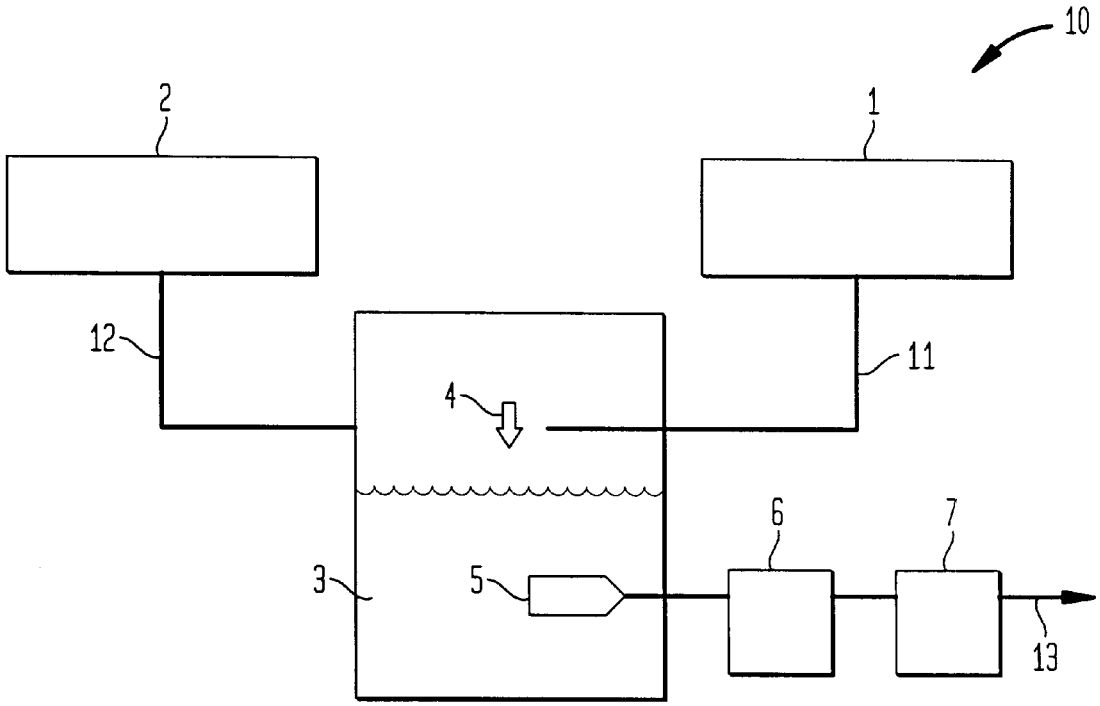

As shown, an apparatus 10 for the production and storage of acetylene includes a source 1 of acetylene gas under pressure and a source 2 of liquid nitrogen. A line 12 extends between the source 2 and a mixing pressure vessel 3. A feeding system 4 is located within the vessel 3 adjacent the upper (as shown) end thereof and a line 11 extends between the source 1 of acetylene and the feeding system 4. Also located in the mixing vessel 3 is a withdrawal system 5. A line 13 extends from the system 5 and located in the line 13 is a vaporiser 6 and a separator 7. In use, liquid nitrogen from source 2 enters the mixing vessel 3 via line 12. Next, acetylene under pressure passes from source 1 through line 11 to the feeding system 4 where it is added to the liquid nitrogen to produce a liquid-solid mixture. Finally, the liquid-solid mixture is withdrawn from the vessel 3 via the withdrawal system 5 and line 13. The vaporiser 6 converts the liquid-solid mixture to a gas mixture of nitrogen and acetylene and the separator 7 separates the nitrogen from the acetylene before delivery to a work site.

The feeding of the acetylene can be done by spraying the acetylene over the liquid nitrogen or sparging the acetylene into the pool of liquid nitrogen.

As an example, a 1 litre of nitrogen and acetylene liquid-solid mixture stored at −188° C. and 2.3 bar absolute total pressure, with a 50 vol % solid to liquid ratio, when vaporised will produce a gas mixture containing 49.6 vol % nitrogen and 50.4 vol % acetylene. The gas mixture will be stable up to 2.5 bar acetylene partial pressure and 5 bar total pressure at ambient temperature. The storage capacity of a convention dissolved acetylene system is 172 g acetylene per litre of storage for the Coyne mass and 188 g acetylene per litre of storage, for the new Norris mass. The liquid-solid mixture in the above example has a storage capacity of 365 g acetylene per litre of storage, which is about twice that of the conventional dissolved acetylene system.

Acetylene has a relatively high triple point −82.2° C., and low solubility in liquid nitrogen, 20 ppm at −178° C. and 0.8 ppm −208° C. Liquid nitrogen is normally stored at pressures from atmospheric up to 23.5 atm absolute with the corresponding saturation temperatures range between −196° C. and −154° C. Therefore, acetylene will solidify if it is sprayed over or sparged into a pool of liquid nitrogen at these conditions. The solid acetylene thus formed will be in the form of fine particles which will be suspended in the liquid nitrogen to form an emulsion or a slurry depending on the size of the solid particles.

The maximum storage pressure will be determined by the maximum pressure available from the acetylene source. The maximum amount of acetylene in the liquid-solid mixture is determined by the viscosity of the liquid/solid mixture, in order that it may be easy to withdraw from the vessel and by the stability of the gas mixture obtained from it. The nitrogen/acetylene gas mixture's stability data at ambient temperature are shown below:

| Total Pressure bar a | Acetylene Partial Pressure, bar a | Vol % Acetylene |
|---|---|---|
| 2.0 | 1.5 | 77 |
| 2.7 | 1.8 | 68 |
| 4.4 | 2.3 | 53 |
| 6.1 | 2.9 | 47 |
| 7.8 | 3.5 | 45 |

The advantage of the system described herein is the very low partial pressure of acetylene in the vapour phase over the liquid-solid mixture, which means the mixture will be protected by a stable vapour. The stability of the mixture will be higher than liquid mixtures as solid acetylene is more stable than liquid acetylene. In addition, it does not have the handling and transport restrictions that liquid acetylene does. Also withdrawal of the solid from the storage system as an emulsion or slurry is more practical than a solid withdrawal from a solid mixture storage. After withdrawal the emulsion or slurry is vaporised thereby producing a gas mixture of nitrogen and acetylene where nitrogen can be easily separated.

Another advantage is the increased storage and transport capacity.

We claim:

1. A method of storing and transporting acetylene, comprising the steps of introducing acetylene under pressure into liquid nitrogen to produce a liquid-solid mixture.

2. The method as claimed claim 1, in which the acetylene is fed to a pool of said liquid nitrogen contained within a pressure vessel to produce a liquid-solid mixture.

3. An apparatus for storing acetylene comprising a source of acetylene gas under pressure, a pressure vessel containing liquid nitrogen, means for feeding the acetylene to the liquid nitrogen to produce a liquid-solid mixture.

* * * * *